United States Patent [19]

Colombo

[11] 4,263,960

[45] Apr. 28, 1981

[54] ROCKING DEVICE FOR CONTINUOUS CASTING MOLDS

[75] Inventor: Piero Colombo, Udine, Italy

[73] Assignee: Continua International Continuous Casting S.P.A., Ferrara, Italy

[21] Appl. No.: 67,428

[22] Filed: Aug. 17, 1979

[30] Foreign Application Priority Data

Aug. 23, 1978 [IT] Italy ..... 12760 A/78

[51] Int. Cl.[3] ..... B22D 11/04

[52] U.S. Cl. ..... 164/416; 74/469

[58] Field of Search ..... 164/83, 416; 74/469

[56] References Cited

U.S. PATENT DOCUMENTS

| | | | |
|---|---|---|---|
| 2,818,616 | 1/1958 | Rossi | 164/416 |
| 3,542,117 | 11/1970 | Lemper et al. | 164/416 X |
| 3,592,258 | 7/1971 | Simons | 164/416 |
| 3,782,446 | 1/1974 | Walter | 164/416 |
| 4,027,724 | 6/1977 | Colombo | 164/416 |

FOREIGN PATENT DOCUMENTS

| | | | |
|---|---|---|---|
| 2008080 | 12/1978 | Fed. Rep. of Germany . | |
| 46-27953 | 8/1971 | Japan | 164/416 |

*Primary Examiner*—Robert D. Baldwin

*Attorney, Agent, or Firm*—Larson, Taylor and Hinds

[57] ABSTRACT

In a continuous casting plant comprising a fixed frame, a table, and a mold supported by said table, a mold rocking device comprising at least one first bell-crank lever keyed at its apex to a first shaft rotatably journalled by said fixed frame, said first lever being pivotably connected at one end to one side of said table; at least one second bell-crank lever keyed at its apex to a second shaft, parallel to said first shaft, rotatably journalled by said fixed frame, said second lever being connected, in a slidable and pivotable manner, at one end to the side of said table opposite to the one to which the said first lever is pivotably connected; the second end of said second bell-crank lever being connected to a rocking device; and means for transmitting the said rocking movement from said second bell-crank lever to the second end of said first bell-crank lever.

5 Claims, 3 Drawing Figures

ROCKING DEVICE FOR CONTINUOUS CASTING MOLDS

FIELD OF THE INVENTION

This invention relates to plants for the continuous casting of metals, and more particularly to mold rocking devices for such plants. More particularly it relates to a mold rocking device of the above kind which may be utilized for rocking both curved molds or straight molds in continuous metal casting plants.

BACKGROUND OF THE INVENTION

Rocking devices for continuous casting molds are known which are suitable for use with arcuated molds to be reciprocated along arcuated paths, and devices are known which are suitable for use with straight molds to be reciprocated along straight paths. The above two basic kinds of rocking devices differ greatly from each other and it is practically impossible to use a rocking device for arcuated molds in a straight mold plant by simply modifying the dimensions and/or the dimension ratios of the components of said devices. In fact, in a straight mold casting plant the mold must be reciprocated according a straight line, whilst in a curved mold casting plant the mold must be reciprocated around a rocking axle coincident with the median curvature center of the curved mold.

Moreover, in the known curved molds plants it is very difficult to adjust the rocking device for use with molds having different curvature radiuses, by simply changing some components of the rocking device.

SUMMARY OF THE INVENTION

This invention aims to obviate to the above and other disadvantages of the known rocking devices for continuous casting plants. According to one feature of the invention, the rocking device for use in continuous casting plants provided with fixed frame and a mold supporting table, comprises: at least one first bell-crank lever keyed at its apex to a first shaft rotatably supported by said fixed frame and pivotably connected at one end to one side of said table; at least one second bell-crank lever keyed at its apex to a second shaft, parallel to said first shaft, rotatably supported by said fixed frame, and connected in a slidable and pivotable manner at one end to the side of said table opposite to the one to which the said first lever is pivotably connected; the second end of said second bell-crank lever being connected to a motor operated rocking device; and means for transmitting the said rocking movement from said second bell-crank lever to said first bell-crank lever.

BRIEF DESCRIPTION OF THE DRAWINGS

Further objects and advantages of the present invention will become apparent from the following specification made with reference to the accompanying drawings, in which.

DESCRIPTION OF THE PREFERRED EMBODIMENT OF THE INVENTION

Figure 1:
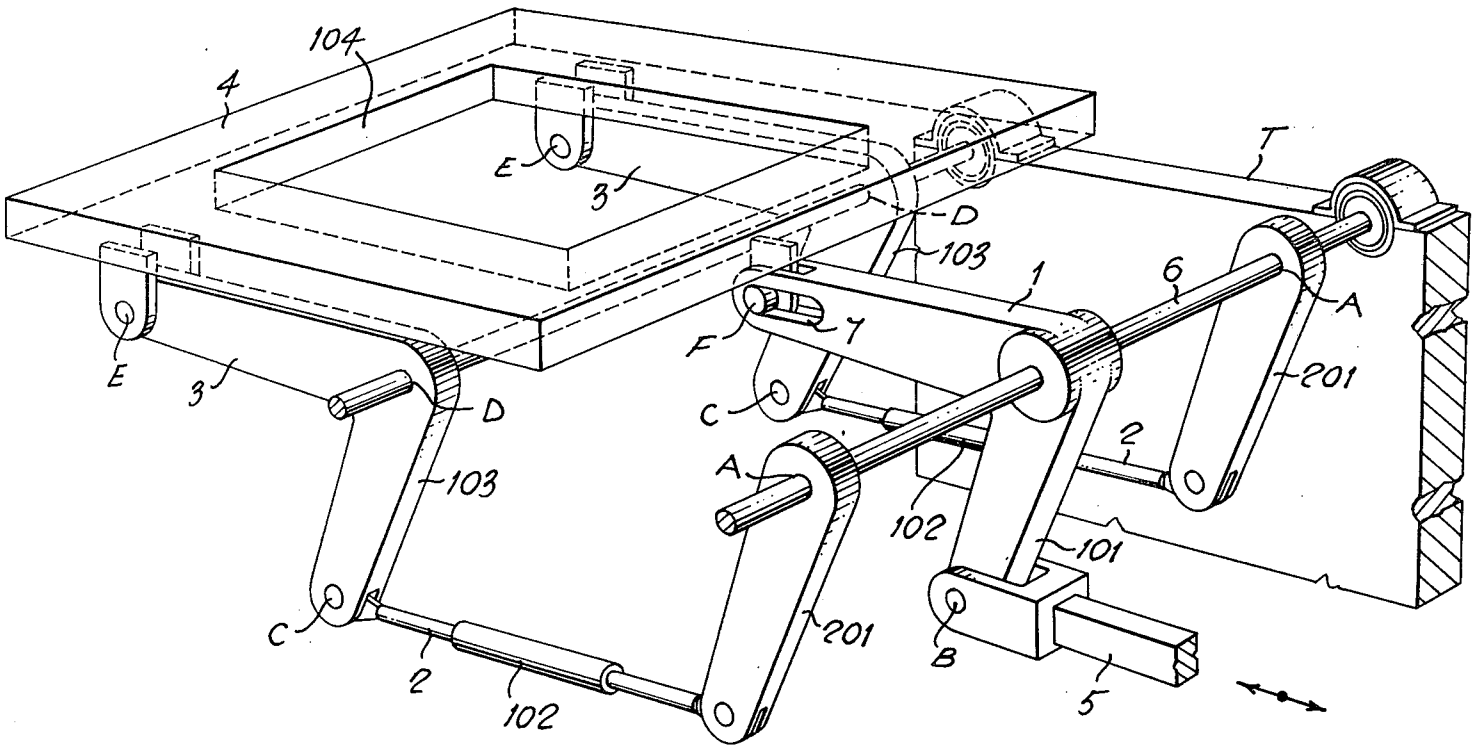
FIG. 1 is a perspective view of the mould supporting table of a continuous casting plant, provided with the mould rocking device according to the invention.
Figure 2:
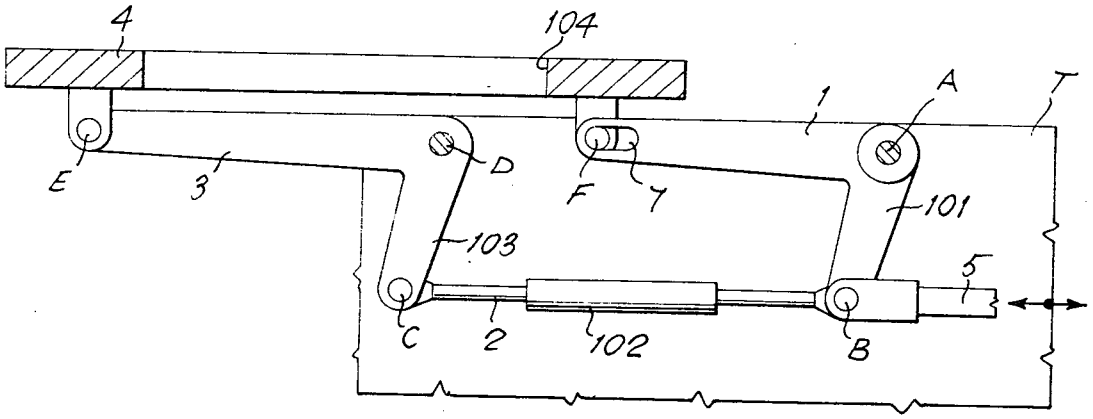
FIG. 2 is a longitudinal cross sectional view of the device of FIG. 1.

With reference to FIGS. 1 and 2 of the drawings, 4 is the mold carrying table of a continuous metal casting plant. The said table is of rectangular shape, and is provided with a central rectangular opening 104 in which the continuous casting mold (not shown) is disposed, and secured in per se known manner, to the table 4. Depending from the lower front side of the table 4 are two pairs of brackets, each supporting a pivot pin E. The pivot pins E are axially aligned. To each pin E one end of the horizontally disposed arms 3 of a pair of parallel bell-crank levers 3–103 is pivotably secured. The bell crank levers 3–103 are keyed at their apex to a shaft D, which is journalled endwise into suitable journals carried by the fixed frame T of the casting plant. The second arm 103 of bell-crank levers extends downwardly with respect to shaft D.

From the lower rear side of the table 4, centrally thereof, a bracket is depending, which carries a transversal pin F, the axis of which is parallel to the axis of pins E.

A bell crank lever 1–101, keyed at its apex to a shaft A, parallel to shaft D, and journalled endwise into suitable journals carried by the frame T, is provided with a substantially horizontal arm 1, which at its free forked end is provided with a longitudinal slot 7 into slidable and rotatable engagement with pin F. The second arm 101 of the bell crank lever is articulated through pin B, to a tie rod 5 positively connected to a reciprocating mechanism (not shown). On shaft A two downwardly extending levers 201 are keyed by one end, the said levers being connected at their other end, in an articulated manner, through the tie rods 2, to the pins C at the free end of the arms 103 of the bell-crank levers 3–103. The tie rod 2 are formed into two parts, connected together by means of threaded sleeves 102, so that by screwing and unscrewing said sleeves, it is possible to adjust the length of the tie rods 2.

OPERATION OF THE DESCRIBED DEVICE

The operation of the described device is evident. By rocking, through rod 5, the bell-crank lever 101–1, the rocking movement is transmitted through arm 1 of bell crank lever to the pin F, and to the table 4. At the same time, this movement is transmitted through shaft A, levers 201, rods 2, bell crank levers 103–3 and pins E to the opposite side of table 4, which is reciprocated along a substantially vertical plane.

Figure 3:
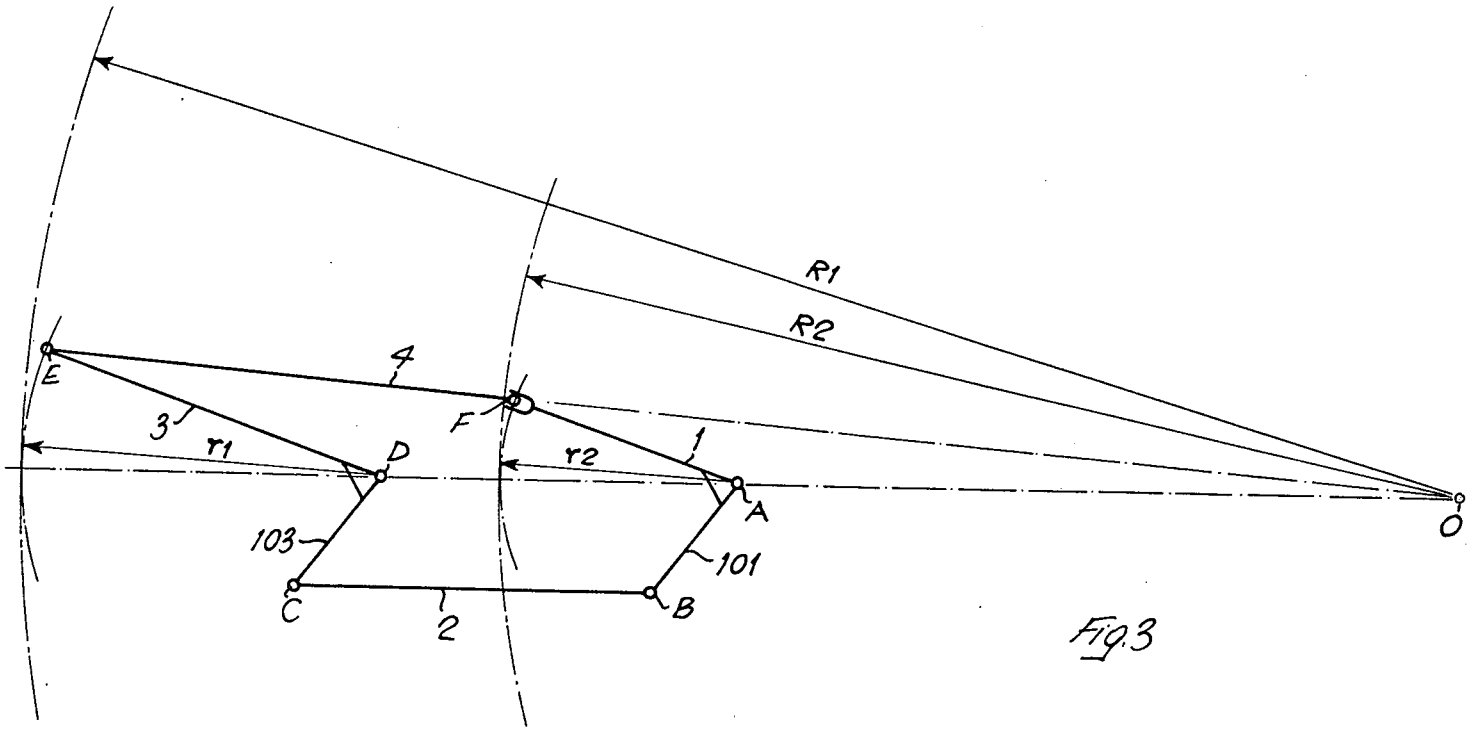
FIG. 3 is the movement diagram of the rocking device of FIGS. 1 and 2.

In order to adjust the said rocking movement for different curvature radiuses of different molds, and also for a straight mold, the following is noted:

With particular reference to FIG. 3, it is first supposed that the rocking movement of the mold carrying table 4 will take place around a curvature center O (center of the circumference of the curved path of the ingot in the continuous casting plant). By indicating with R1 the sum of the segments ED (corresponding to the length of arm 3 of lever 3–103 from pivot axle E to pivot axle D) and DO (corresponding to the distance from pivot axle D to curvature center O) and with R2 the sum of the segments FA (corresponding to the distance from pivot F to axle of shaf A) and AO. By assuming r1 as the distance $\overline{ED}$ and r2 as the distance $\overline{FA}$, and by further assuming a1 the distance $\overline{DC}$ (that is the length of arm 103 of lever 3–103) and a2 the distance $\overline{AB}$ (that is the length of arm 101) with the points D and A into alignment with the center O. With the above conditions, and assuming $$a1 = a2 \text{ and } \frac{R1}{R2} = \frac{r1}{r2}$$

at any moment of the rocking movement of the table 4 the segment EF, representing the table 4 in the diagram of FIG. 3, will lay on a straight line passing through the center O, and the path of any point of the mold carried by said table will quite well approximate the ideal path (arc of circumference having the center in O).

If, on the other side, it is supposed that the rocking movement of the mold carrying table is to be performed along a straight line, by assuming $$a1 = a2 \text{ and } r1 = r2$$

it will be seen that the mold carrying table at any moment of its roking movement will be on a straight line parallel to the straight line DAO, and that thus the movement of the mold carried by said table will approximate quite well the ideal straight path.

Thus, by simply varying the length or the ratio between the lengths of the arms 3 and 103, and 1 and 101 of the bell crank levers, it is practically possible to adjust the rocking device for molds of different curvature, and also for straight molds.

Having thus described my invention, what I claim is:

1. In a continuous casting plant comprising a fixed frame, a table, and a mold supported by said table, a mold rocking device comprising at least one first bell-crank lever keyed at its apex to a first shaft rotatably journalled by said fixed frame, said first lever being pivotably connected at one end to one side of said table; at least one second bell-crank lever keyed at its apex to a second shaft, parallel to said first shaft, rotatably journalled by said fixed frame, said second lever being connected in a slidable and pivotable manner at one end to the side of said table opposite the one to which the said first lever is pivotably connected; the second end of said second bell-crank lever being connected to a motor operated rocking device; and means for transmitting the said rocking movement from said second lever to the second end of said first bell-crank lever.

2. A mold rocking device according to claim 1, in which the said means for transmitting the movement from said second bell-crank lever to said first bell-crank lever comprises at least one third lever keyed on said second shaft, and articulated tie-rod means connecting the free end of said third lever to the second end of said first bell-crank lever.

3. A mold rocking device according to claim 1, in which the said first bell-crank lever is pivotably connected to the extrados side of the said mold carrying table, and the said second bell-crank lever is pivotably and slidably connected to the intrados side of said mold carying table.

4. A mold rocking device according to claim 1, in which the said first and second shafts are coplanar, and lie on the same plane on which the middle curvature center of the mold lies.

5. A mold rocking device according to claim 1, in which there are two first bell-crank levers which are disposed at the two corners of one side of the said table, and the said second bell-crank lever is disposed at the middle of the opposite side of the table, the said table being supported during its rocking movement by said bell-crank levers.

* * * * *